US009332367B1

(12) United States Patent
Chiu et al.

(10) Patent No.: US 9,332,367 B1
(45) Date of Patent: May 3, 2016

(54) HEADSET TEST DEVICE

(71) Applicant: Cheng Uei Precision Industry Co., Ltd., New Taipei (TW)

(72) Inventors: Chun Ching Chiu, New Taipei (TW); Chih Jen Chang, New Taipei (TW); Shih Hsuan Chiu, New Taipei (TW); Nai Ching Wang, New Taipei (TW); Cheng Chin Chen, New Taipei (TW); Kun Ting Chen, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 32 days.

(21) Appl. No.: 14/567,396

(22) Filed: Dec. 11, 2014

(51) Int. Cl.
*H04R 29/00* (2006.01)

(52) U.S. Cl.
CPC ..... *H04R 29/001* (2013.01)

(58) Field of Classification Search
None
See application file for complete search history.

(56) References Cited

U.S. PATENT DOCUMENTS 8,977,376 B1 * 3/2015 Lin ..... H04R 29/00 381/58
2015/0003649 A1 * 1/2015 Horbach ..... H04R 29/00 381/309

* cited by examiner

*Primary Examiner* — Thang Tran
(74) *Attorney, Agent, or Firm* — WPAT, P.C., Intellectual Property Attorneys; Anthony King

(57) ABSTRACT

A headset test device includes a supporting frame, a drive adjusting system, a head model mechanism and a sensing system. The supporting frame includes a transverse adjusting supporter assembly and a vertical adjusting supporter assembly. The drive adjusting system includes a first motor and a second motor. The transverse adjusting supporter assembly and the vertical adjusting supporter assembly are connected with and are driven by the first motor and the second motor, respectively. The head model mechanism includes a parietal region driven by the second motor to vertically move, and two aural regions driven by the first motor to move close to or away from each other for increasing or reducing a distance between the two aural regions. Each of the two aural regions is equipped with an artificial ear. The sensing system includes a force sensing unit, a pressure sensing unit and a temperature sensing unit.

13 Claims, 4 Drawing Sheets

HEADSET TEST DEVICE

BACKGROUND OF THE INVENTION

1. Field of the Invention

The present invention generally relates to a test device, and more particularly to a headset test device.

2. the Related Art

Nowadays, an ordinary music amateur, except for pursuing high quality sound of a headset, requires a comfort degree of wearing the headset to be higher and higher. When the music amateur wears the headset to enjoy better music, in order to avoid hearing damage of the music amateur, it need specify clamping pressure for preventing the clamping pressure being too larger to destroy the hearting of the music amateur. In addition to this, when the headset is worn by the music amateur, affections of a force, such as a clamping force and a temperature of the headset to ears of the music amateur are paid a great attention.

However, the clamping pressure, the force and the temperature are generally tested separately by virtue of more than one headset test device that brings an inconvenience to know quantitative data of the comfort degree of wearing the headset. Thus, it is difficult to provide the headset with the better comfort degree for the music amateur.

So an innovative headset test device is needed, the clamping pressure, the force and the temperature are tested by virtue of the single innovative headset test device to know the quantitative data of the comfort degree of wearing the innovative headset. Thus, it facilitates providing the innovative headset with the better comfort degree for the music amateur.

SUMMARY OF THE INVENTION

An object of the present invention is to provide a headset test device. The headset test device includes a supporting frame, a drive adjusting system, a head model mechanism and a sensing system. The supporting frame includes a fixing base, a transverse adjusting supporter assembly and a vertical adjusting supporter assembly which are mounted on the fixing base. The drive adjusting system includes a first motor and a second motor. The transverse adjusting supporter assembly and the vertical adjusting supporter assembly are connected with and are driven by the first motor and the second motor, respectively. The head model mechanism includes a parietal region and two aural regions. The parietal region is mounted on the vertical adjusting supporter assembly, and is driven by the second motor to vertically move along the vertical adjusting supporter assembly. The two aural regions are abreast mounted to two opposite sides of the transverse adjusting supporter assembly transversely. The two aural regions are driven by the first motor to move close to or away from each other along the transverse adjusting supporter assembly for increasing or reducing a distance between the two aural regions. Each of the two aural regions is equipped with an artificial ear. The parietal region is located above an interval between the two aural regions. The sensing system includes a force sensing unit, a pressure sensing unit and a temperature sensing unit. The force sensing unit is disposed to one of the aural regions. The pressure sensing unit is disposed to the parietal region and the aural regions. The temperature sensing unit is disposed in the artificial ears of the aural regions.

As described above, the headset test device adjusts a distance between the parietal region and the aural regions to simulate different widths and heights of different heads by virtue of the first motor and the second motor, and clamping pressure, a force and a temperature are tested by virtue of the single headset test device to know the quantitative data of the comfort degree of wearing the headset. Thus, it facilitates providing the headset with the better comfort degree for the music amateur.

BRIEF DESCRIPTION OF THE DRAWINGS

The present invention will be apparent to those skilled in the art by reading the following description, with reference to the attached drawings, in which.

DETAILED DESCRIPTION OF THE EMBODIMENT

Figure 1:
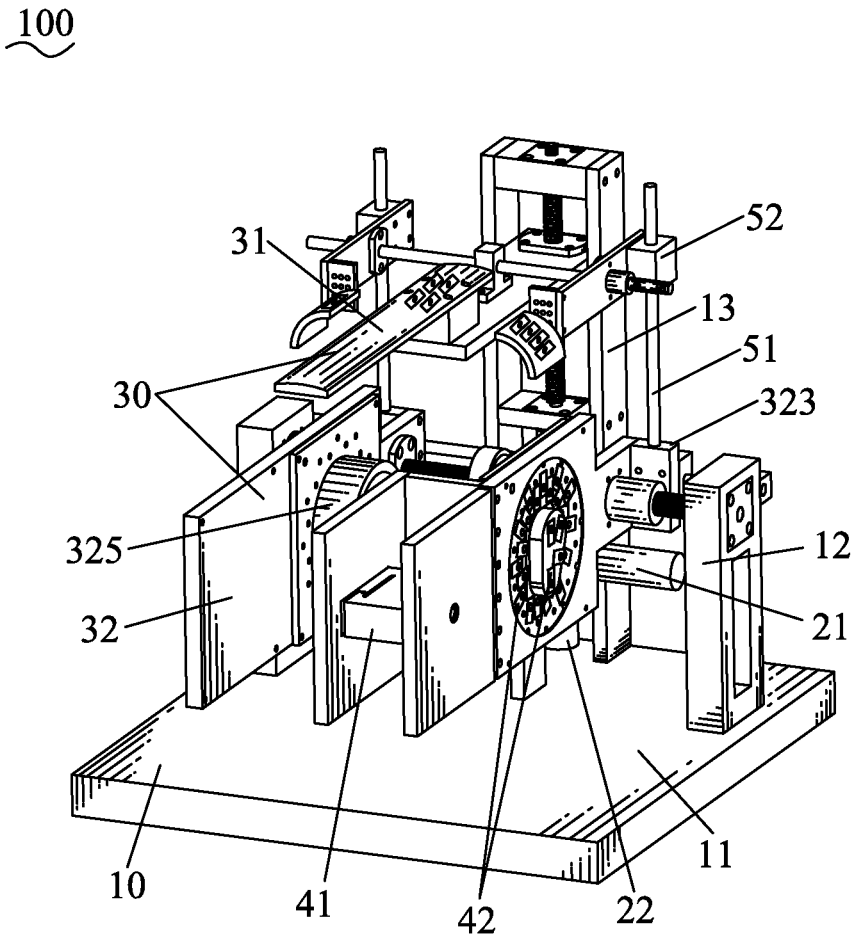
FIG. 1 is a perspective view of a headset test device in accordance with an embodiment of the present invention.
Figure 2:
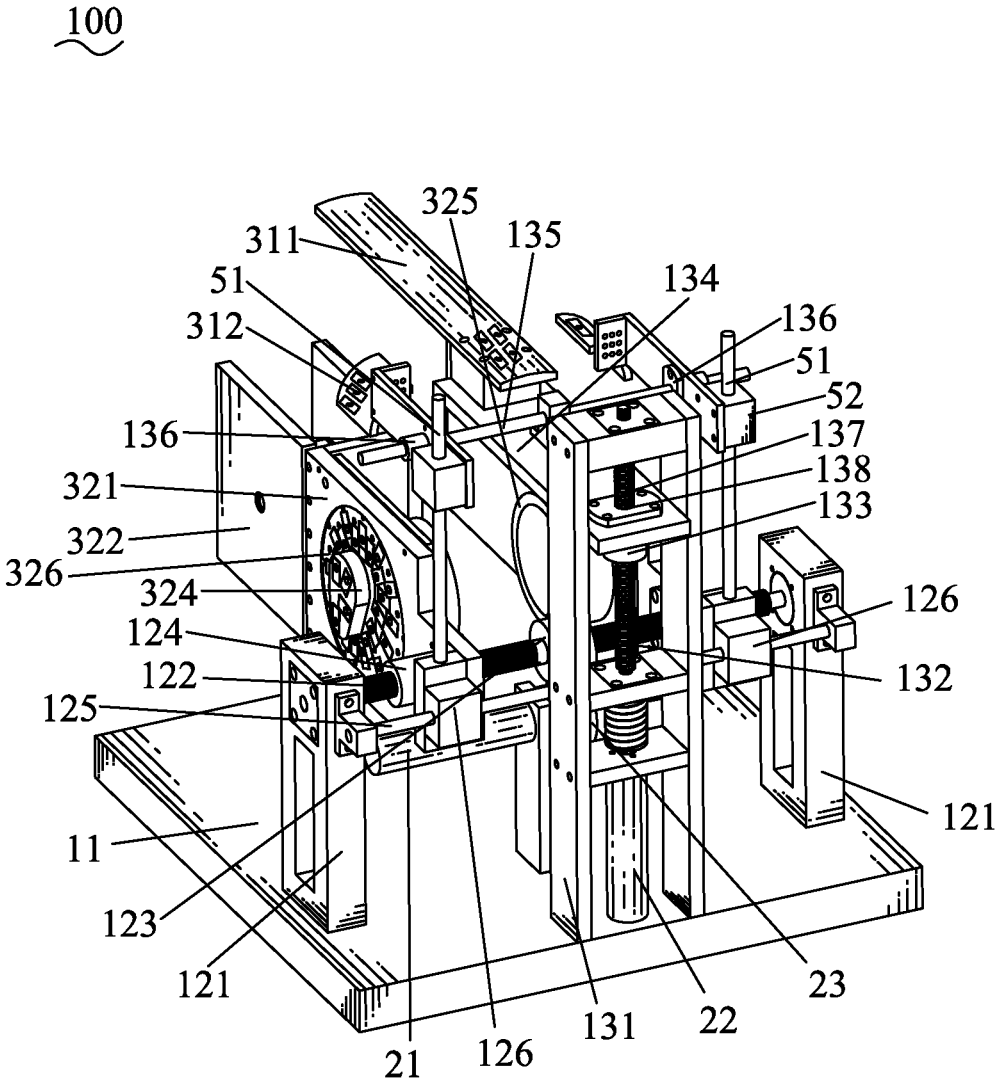
FIG. 2 is another perspective view of the headset test device of FIG. 1.
Figure 3:
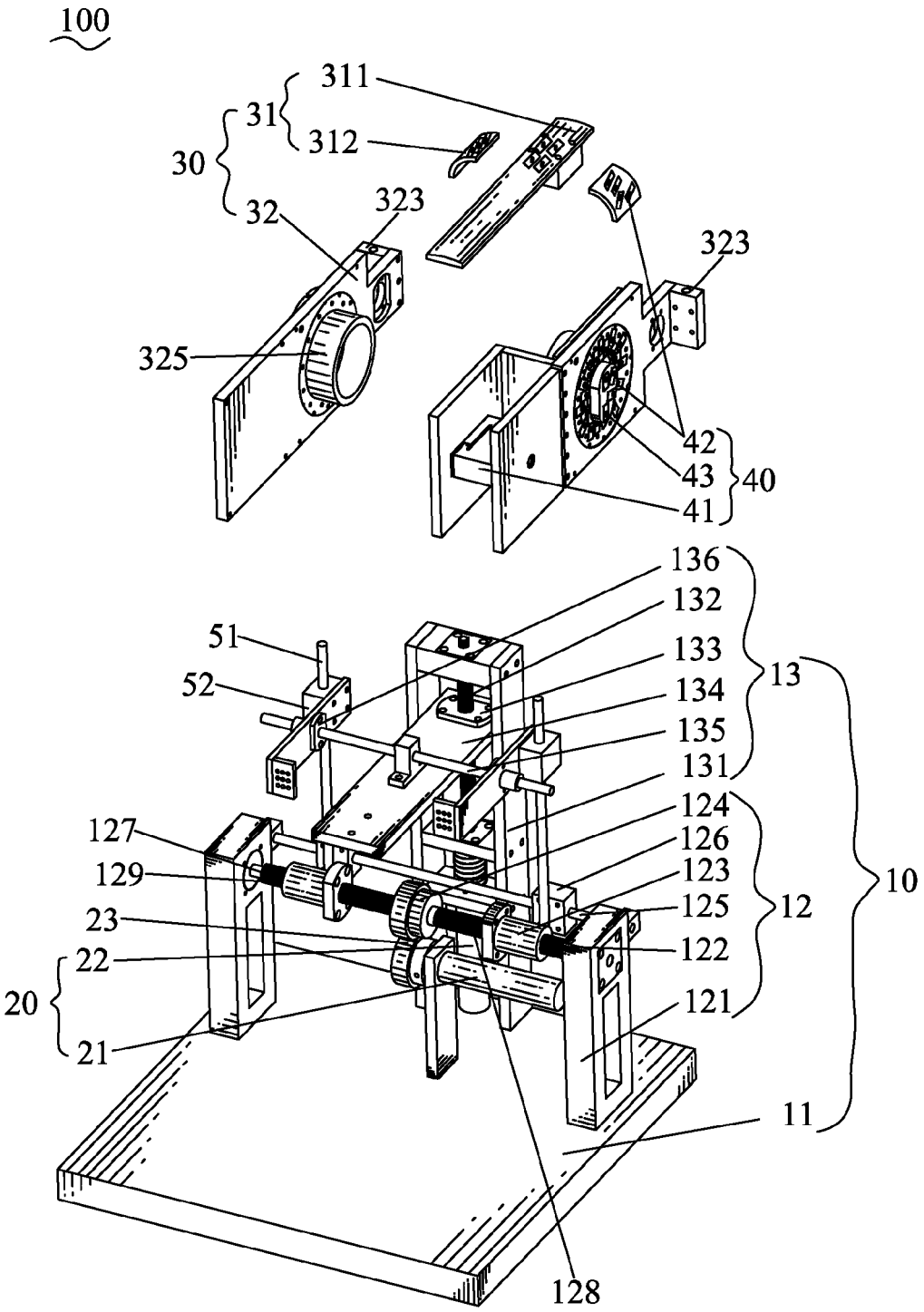
FIG. 3 is a partially exploded view of the headset test device of FIG. 1.
Figure 4:
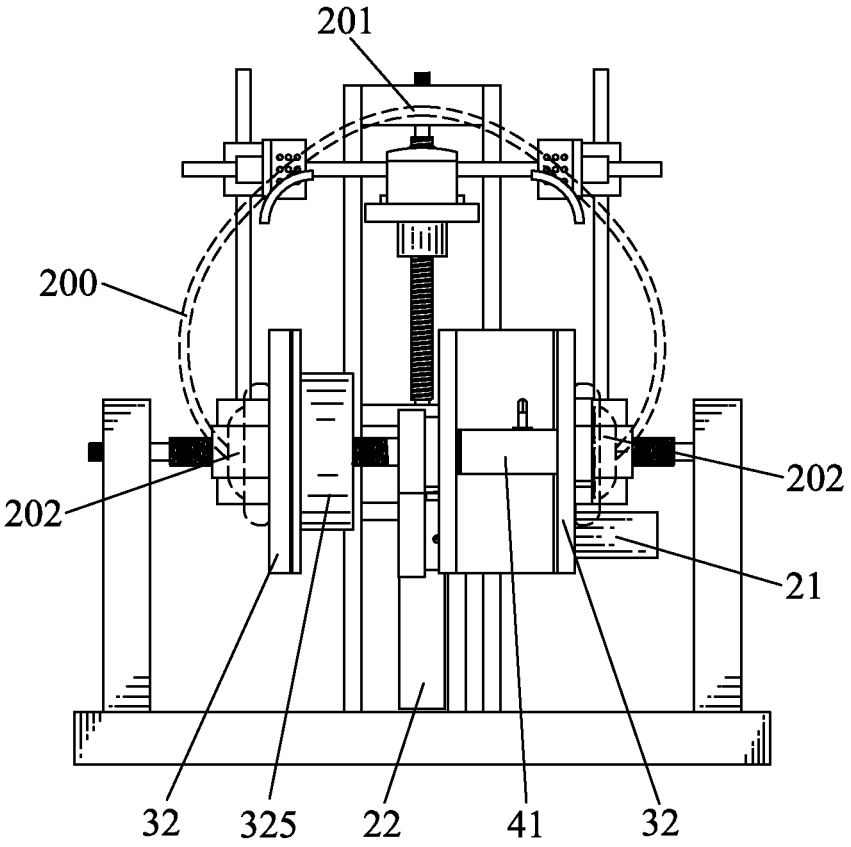
FIG. 4 is a front view of the headset test device of FIG. 1, wherein a headset is tested by the headset test device.

Referring to FIG. 1, FIG. 2 and FIG. 3, a headset test device 100 in accordance with an embodiment of the present invention is shown. The headset test device 100 is adapted for testing physical quantities of a headset 200 to know quantitative data of a comfort degree of wearing the headset 200 to provide the headset 200 with the better comfort degree for a music amateur who wears the headset 200. The headset test device 100 includes a supporting frame 10, a drive adjusting system 20, a head model mechanism 30 and a sensing system 40. The drive adjusting system 20 includes a first motor 21 and a second motor 22.

Referring to FIG. 1 to FIG. 3, the supporting frame 10 includes a fixing base 11, a transverse adjusting supporter assembly 12 and a vertical adjusting supporter assembly 13 which are mounted on the fixing base 11. Specifically, the transverse adjusting supporter assembly 12 includes two fastening elements 121, a transverse rotating shaft 122, a first transmitting roller 123, two first threaded sleeve components 124 and a first sliding rod 125. Two outsides of two opposite sides of the transverse rotating shaft 122 respectively define a plurality of first external threads 127 and a plurality of second external threads 128 which spiral in opposite directions. An inside of each of the first threaded sleeve components 124 defines a plurality of first internal threads 129. The two fastening elements 121 are respectively mounted on two opposite sides of the fixing base 11 vertically. The first transmitting roller 123 is mounted around a middle of the transverse rotating shaft 122. The transverse rotating shaft 122 together with the first transmitting roller 123 is pivotally mounted between the two fastening elements 121.

Referring to FIG. 1 to FIG. 3, the two first threaded sleeve components 124 respectively surround the two opposite sides of the transverse rotating shaft 122. The transverse rotating shaft 122 rotates to make the first internal threads 129 of the two first threaded sleeve components 124 respectively engaged with the first external threads 127 and the second external threads 128 of the two opposite sides of the two transverse rotating shaft 122 so as to drive the two first threaded sleeve components 124 to transversely move along the transverse rotating shaft 122. The transverse adjusting supporter assembly 12 further includes two sliding blocks 126. The two sliding blocks 126 are respectively disposed around two opposite sides of the first sliding rod 125. The first sliding rod 125 together with the two sliding blocks 126 is fastened between the two fastening elements 121. The first sliding rod 125 is parallel to and is located behind the transverse rotating shaft 122.

Referring to FIG. 1 to FIG. 3, the vertical adjusting supporter assembly 13 includes a limiting element 131, a vertical rotating shaft 132, a second threaded sleeve component 133, a fastening plate 134, a second sliding rod 135 and two slidable locating elements 136. An outside of the vertical rotating shaft 132 defines a plurality of third external threads 137. An inside of the second threaded sleeve component 133 defines a plurality of second internal threads 138. The limiting element 131 is vertically mounted on the fixing base 11 and is located behind the transverse adjusting supporter assembly 12. The second threaded sleeve component 133 surrounds the vertical rotating shaft 132. The fastening plate 134 is fastened to the second threaded sleeve component 133 and is parallel to the fixing base 11.

Referring to FIG. 1 to FIG. 3, the vertical rotating shaft 132 is capable of rotating. The vertical rotating shaft 132 penetrates through a top of the limiting element 131 to make the vertical rotating shaft 132 vertically mounted to the limiting element 131. The vertical rotating shaft 132 rotates to make the third external threads 137 of the vertical rotating shaft 132 engaged with the second internal threads 138 of the second threaded sleeve component 133 so as to drive the second threaded sleeve component 133 together with the fastening plate 134 to vertically move along the vertical rotating shaft 132. The second sliding rod 135 is mounted on the fastening plate 134 and is parallel to the transverse rotating shaft 122. The two slidable locating elements 136 are slidably disposed around two opposite sides of the second sliding rod 135. The two slidable locating elements 136 are capable of transversely sliding along the second sliding rod 135.

Referring to FIG. 2 and FIG. 3, the transverse adjusting supporter assembly 12 and the vertical adjusting supporter assembly 13 are connected with and are driven by the first motor 21 and the second motor 22, respectively. The drive adjusting system 20 further includes a second transmitting roller 23. The first motor 21 is mounted on the fixing base 11. The second transmitting roller 23 is mounted around one end of the first motor 21. The first motor 21 rotates to drive the second transmitting roller 23 to rotate so as to drive the first transmitting roller 123 together with the transverse rotating shaft 122 to rotate by virtue of the second transmitting roller 23 being engaged with the first transmitting roller 123. The second motor 22 is connected to a bottom end of the vertical rotating shaft 132 so that the second motor 22 drives the vertical rotating shaft 132 to rotate.

Referring to FIG. 2 and FIG. 3, the head model mechanism 30 includes a parietal region 31 and two aural regions 32. The parietal region 31 is mounted on the vertical adjusting supporter assembly 13, and is driven by the second motor 22 to vertically move along the vertical adjusting supporter assembly 13. The two aural regions 32 are abreast mounted to two opposite sides of the transverse adjusting supporter assembly 12 transversely. The two aural regions 32 are driven by the first motor 21 to move close to or away from each other along the transverse adjusting supporter assembly 12 for increasing or reducing a distance between the two aural regions 32. Each of the two aural regions 32 is equipped with an artificial ear 324. The parietal region 31 is located above an interval between the two aural regions 32.

Referring to FIG. 1 to FIG. 3, specifically, the parietal region 31 includes a top portion 311 and two lateral portions 312. The top portion 311 is mounted on the fastening plate 134, and is located in front of second sliding rod 135. A front end of the top portion 311 projects beyond a front of the fastening plate 134. The two lateral portions 312 are fastened to two fronts of the two slidable locating elements 136 and are located above the two aural regions 32, respectively. Each of the two aural regions 32 includes a first sensing area 321, and a second sensing area 322 located in front of the first sensing area 321. The first sensing area 321 is corresponding to a bottom of one of the lateral portions 312. The artificial ear 324 is assembled to an outer side of the first sensing area 321. Two rear ends of the two aural regions 32 are respectively fastened to the two first threaded sleeve components 124. The head model mechanism 30 further includes two first connecting blocks 323. The two first connecting blocks 323 are fastened to the two rear ends of the two aural regions 32, respectively. The two sliding blocks 126 are respectively fastened to two rear surfaces of the two first connecting blocks 323. So the two first threaded sleeve components 124 are respectively connected with the two sliding blocks 126. The first threaded sleeve components 124 transversely move along the transverse rotating shaft 122 to drive the aural regions 32 to transversely move along the first sliding rod 125.

Referring to FIG. 1 to FIG. 3 again, the headset test device 100 further includes two guiding rods 51 and two second connecting blocks 52. The two guiding rods 51 are respectively fastened to the two first connecting blocks 323 vertically. Two rear ends of the two slidable locating elements 136 are slidably disposed to the two guiding rods 51 by virtue of the two second connecting blocks 52, respectively. The two slidable locating elements 136 are capable of sliding upward and downward along the two guiding rods 51, respectively. The two aural regions 32 are respectively connected with the two slidable locating elements 136 by virtue of the two rear ends of the two slidable locating elements 136 being slidably disposed to the two guiding rods 51, respectively and the two first connecting blocks 323 being fastened to the two rear ends of the two aural regions 32, respectively. So when the two aural regions 32 are driven to move close to or away from each other for increasing or reducing the distance between the two aural regions 32, the two lateral portions 312 together with the two slidable locating elements 136 are driven to move close to or away from each other along the second sliding rod 135 for increasing or reducing a distance between the two lateral portions 312. An inner side of the first sensing area 321 of each of the two aural regions 32 is equipped with a heating unit 325 for heating peripheral components of fastening the artificial ear 324 to simulate a human body temperature.

Referring to FIG. 2 and FIG. 3, the sensing system 40 includes a force sensing unit 41, a pressure sensing unit 42 and a temperature sensing unit 43. The force sensing unit 41 is disposed to the second sensing area 322 of one of the aural regions 32. The pressure sensing unit 42 is disposed to the parietal region 31 and the aural regions 32. Specifically, the pressure sensing unit 42 is disposed to the top portion 311, the two lateral portions 312, the two artificial ears 324 and two circumjacent areas 326 of the two first sensing areas 321 respectively around the two artificial ears 324. The temperature sensing unit 43 is disposed in the artificial ears 324 of the aural regions 32.

Referring to FIG. 1 to FIG. 4, when the headset test device 100 is in use, the first motor 21 is started, the first motor 21 rotates in a forward direction. The first motor 21 drives the transverse rotating shaft 122 to rotate by virtue of the second transmitting roller 23 being mounted around one end of the first motor 21, the first transmitting roller 123 being mounted around the middle of the transverse rotating shaft 122, and the second transmitting roller 23 being engaged with the first transmitting roller 123. At the moment, the two first threaded sleeve components 124 are driven to transversely move along the transverse rotating shaft 122 by virtue of the first internal threads 129 of the two first threaded sleeve components 124 being respectively engaged with the first external threads 127 and the second external threads 128 of the two opposite sides of the two transverse rotating shaft 122. So the two first threaded sleeve components 124 are away from each other to increase the distance between the two aural regions 32. The two lateral portions 312 are away from each other with the two first threaded sleeve components 124 being away from each other by virtue of the two aural regions 32 being respectively connected with the two slidable locating elements 136. The distance between the two lateral portions 312 is increased. When the first motor 21 rotates in the reverse direction, the distance between the two aural regions 32 are reduced, and simultaneously, the distance between the two lateral portions 312 are reduced. So that a width of the head model mechanism 30 is adjusted.

Referring to FIG. 1 to FIG. 4 again, when the second motor 22 is started to rotate in the forward direction, the second motor 22 drives the vertical rotating shaft 132 to rotate so as to drive the second threaded sleeve component 133 to move upward along the third external threads 137 of the vertical rotating shaft 132. The second threaded sleeve component 133 drives the fastening plate 134 and the second sliding rod 135 to move upward so that the second sliding rod 135 drives the two slidable locating elements 136 to move upward respectively along the two guiding rods 51. A distance between the parietal region 31 and the aural regions 32 is increased. When the second motor 22 rotates in the reverse direction, the distance between the parietal region 31 and the aural regions 32 is reduced. So that headset test device 100 adjusts the distance between the parietal region 31 and the aural regions 32 to simulate different widths and heights of different heads by virtue of the first motor 21 and the second motor 22.

After completing adjusting the head model mechanism 30, the headset 200 is worn on the head model mechanism 30. Specifically, the headset 200 includes a wearing portion 201 and two earcaps 202. The wearing portion 201 is worn on the top portion 311 and the two lateral portions 312 of the parietal region 31. The two earcaps 202 are worn on the two first sensing areas 321. The temperature sensing unit 43 disposed in the two artificial ears 324 senses quantitative data of a temperature. The pressure sensing unit 42 senses quantitative data of clamping pressure. Then the two earcaps 202 are respectively worn on the second sensing areas 322, the force sensing unit 41 senses quantitative data of a force. In this embodiment, the force sensing unit 41 senses the quantitative data of a clamping force. So the headset test device 100 tests the physical quantities of the headset 200, including the clamping pressure, the force and the temperature, to know the quantitative data of the comfort degree of wearing the headset 200.

As described above, the headset test device 100 adjusts the distance between the parietal region 31 and the aural regions 32 to simulate different widths and heights of different heads by virtue of the first motor 21 and the second motor 22, and the clamping pressure, the force and the temperature are tested by virtue of the single headset test device 100 to know the quantitative data of the comfort degree of wearing the headset 200. Thus, it facilitates providing the headset 200 with the better comfort degree for the music amateur.

What is claimed is:

1. A headset test device, comprising:

a supporting frame including a fixing base, a transverse adjusting supporter assembly and a vertical adjusting supporter assembly which are mounted on the fixing base;

a drive adjusting system including a first motor and a second motor, the transverse adjusting supporter assembly and the vertical adjusting supporter assembly being connected with and being driven by the first motor and the second motor, respectively;

a head model mechanism including a parietal region and two aural regions, the parietal region being mounted on the vertical adjusting supporter assembly, and being driven by the second motor to vertically move along the vertical adjusting supporter assembly, the two aural regions being abreast mounted to two opposite sides of the transverse adjusting supporter assembly transversely, the two aural regions being driven by the first motor to move close to or away from each other along the transverse adjusting supporter assembly for increasing or reducing a distance between the two aural regions, each of the two aural regions being equipped with an artificial ear, the parietal region being located above an interval between the two aural regions; and a sensing system including a force sensing unit, a pressure sensing unit and a temperature sensing unit, the force sensing unit being disposed to one of the aural regions, the pressure sensing unit being disposed to the parietal region and the aural regions, the temperature sensing unit being disposed in the artificial ears of the aural regions.

2. The headset test device as claimed in claim 1, wherein the transverse adjusting supporter assembly includes two fastening elements, a transverse rotating shaft, a first transmitting roller, two first threaded sleeve components, a first sliding rod and two sliding blocks, the two fastening elements are respectively mounted on two opposite sides of the fixing base vertically, the first transmitting roller is mounted around a middle of the transverse rotating shaft, the transverse rotating shaft together with the first transmitting roller is pivotally mounted between the two fastening elements, the two first threaded sleeve components respectively surround two opposite sides of the transverse rotating shaft, the transverse rotating shaft rotates so as to drive the two first threaded sleeve components to transversely move along the transverse rotating shaft, the two sliding blocks are respectively disposed around two opposite sides of the first sliding rod, the first sliding rod together with the two sliding blocks is fastened between the two fastening elements, the first sliding rod is parallel to and is located behind the transverse rotating shaft.

3. The headset test device as claimed in claim 2, wherein two outsides of the two opposite sides of the transverse rotating shaft respectively define a plurality of first external threads and a plurality of second external threads which spiral in opposite directions, an inside of each of the first threaded sleeve components defines a plurality of first internal threads, the transverse rotating shaft rotates to make the first internal threads respectively engaged with the first external threads and the second external threads so as to drive the two first threaded sleeve components to transversely move along the transverse rotating shaft.

4. The headset test device as claimed in claim 2, wherein the first motor is mounted on the fixing base, the drive adjusting system further includes a second transmitting roller mounted around one end of the first motor, the first motor rotates to drive the second transmitting roller to rotate so as to drive the first transmitting roller together with the transverse rotating shaft to rotate by virtue of the second transmitting roller being engaged with the first transmitting roller.

5. The headset test device as claimed in claim 2, wherein the vertical adjusting supporter assembly includes a limiting element, a vertical rotating shaft, a second threaded sleeve component and a fastening plate, the limiting element is vertically mounted on the fixing base and is located behind the transverse adjusting supporter assembly, the second threaded sleeve component surrounds the vertical rotating shaft, the fastening plate is fastened to the second threaded sleeve component and is parallel to the fixing base, the vertical rotating shaft is vertically mounted to the limiting element.

6. The headset test device as claimed in claim 5, wherein the second motor is connected to a bottom end of the vertical rotating shaft so that the second motor drives the vertical rotating shaft to rotate.

7. The headset test device as claimed in claim 5, wherein an outside of the vertical rotating shaft defines a plurality of third external threads, an inside of the second threaded sleeve component defines a plurality of second internal threads, the vertical rotating shaft rotates to make the third external threads engaged with the second internal threads so as to drive the second threaded sleeve component together with the fastening plate to vertically move along the vertical rotating shaft.

8. The headset test device as claimed in claim 5, wherein the vertical adjusting supporter further includes a second sliding rod and two slidable locating elements, the second sliding rod is mounted on the fastening plate and is parallel to the transverse rotating shaft, the two slidable locating elements are slidably disposed around two opposite sides of the second sliding rod, the two slidable locating elements are capable of transversely sliding along the second sliding rod, the vertical rotating shaft rotates so as to drive the second threaded sleeve component together with the fastening plate to vertically move along the vertical rotating shaft.

9. The headset test device as claimed in claim 8, wherein the parietal region includes a top portion and two lateral portions, the top portion is mounted on the fastening plate, and is located in front of second sliding rod, a front end of the top portion projects beyond a front of the fastening plate, the two lateral portions are fastened to two fronts of the two slidable locating elements and are respectively located above the two aural regions.

10. The headset test device as claimed in claim 9, wherein each of the two aural regions includes a first sensing area, and a second sensing area located in front of the first sensing area, the first sensing area is corresponding to a bottom of one of the lateral portions, the artificial ear is assembled to an outer side of the first sensing area, an inner side of the first sensing area of each of the two aural regions is equipped with a heating unit for heating peripheral components of fastening the artificial ear.

11. The headset test device as claimed in claim 10, wherein the force sensing unit is disposed to the second sensing area of one of the aural regions, the pressure sensing unit is disposed to the top portion, the two lateral portions, the two artificial ears and two circumjacent areas of the two first sensing areas respectively around the two artificial ears.

12. The headset test device as claimed in claim 9, wherein two rear ends of the two aural regions are respectively fastened to the two first threaded sleeve components, the head model mechanism further includes two first connecting blocks fastened to the two rear ends of the two aural regions, respectively, the two sliding blocks are respectively fastened to two rear surfaces of the two first connecting blocks, so the two first threaded sleeve components are respectively connected with the two sliding blocks, the first threaded sleeve components transversely move along the transverse rotating shaft to drive the two aural regions to transversely move along the first sliding rod.

13. The headset test device as claimed in claim 12, further comprising two guiding rods and two second connecting blocks, the two guiding rods being respectively fastened to the two first connecting blocks vertically, two rear ends of the two slidable locating elements being slidably disposed to the two guiding rods, respectively, two rear ends of the two slidable locating elements being slidably disposed to the two guiding rods by virtue of the two second connecting blocks, respectively, the two slidable locating elements being capable of sliding upward and downward along the two guiding rods, respectively.

* * * * *